United States Patent [19]

Dolbear

[11] 4,101,416

[45] Jul. 18, 1978

[54] PROCESS FOR HYDROGENATION OF HYDROCARBON TARS

[75] Inventor: Geoffrey E. Dolbear, Diamond Bar, Calif.

[73] Assignee: Occidental Petroleum Corporation, Los Angeles, Calif.

[21] Appl. No.: 700,002

[22] Filed: Jun. 25, 1976

[51] Int. Cl.[2] ..... C10G 13/06; C07C 15/02

[52] U.S. Cl. ..... 208/108; 208/108; 208/44; 208/57; 208/102; 208/144; 260/668 R

[58] Field of Search ..... 208/108–112, 208/10, 44, 56, 57, 58, 59, 143, 144, 145; 260/667

[56] References Cited

U.S. PATENT DOCUMENTS

| | | | |
|---|---|---|---|
| 3,453,202 | 7/1969 | Friedman et al. | 208/40 |
| 3,480,540 | 11/1969 | Eng et al. | 208/93 |
| 3,502,571 | 3/1970 | Stolfa | 208/108 |
| 3,554,898 | 1/1971 | Wood et al. | 208/59 |
| 3,592,761 | 7/1971 | Cole et al. | 208/108 |
| 3,600,298 | 8/1971 | Mayumi et al. | 208/44 |
| 3,707,459 | 12/1972 | Mason et al. | 208/76 |
| 3,755,139 | 8/1973 | McClaren et al. | 208/44 |
| 3,920,536 | 11/1975 | Seitzer et al. | 208/10 |
| 3,923,634 | 12/1975 | Silvestri et al. | 208/10 |
| 3,932,266 | 1/1976 | Sze et al. | 208/10 |
| 3,944,480 | 3/1976 | Schroeder | 208/10 |

*Primary Examiner*—Delbert E. Gantz
*Assistant Examiner*—G. E. Schmitkons
*Attorney, Agent, or Firm*—Christie, Parker & Hale

[57] ABSTRACT

Hydrocarbon tars of high asphaltene content such as tars obtained from pyrolysis of coal are dissolved in a solvent formed from the hydrogenation of the coal tars, and the resultant mixture hydrogenated in the presence of a catalyst at a pressure from about 1500 to 5000 psig at a temperature from about 500° F to about the critical temperature of the solvent to form a light hydrocarbon as a solvent for the tars. Hydrogen content is at least three times the amount of hydrogen consumed.

18 Claims, No Drawings

PROCESS FOR HYDROGENATION OF HYDROCARBON TARS

The government has rights in or in respect of this invention pursuant to Contract N. E(49-18)-2244 awarded by the United States Energy Research and Development Administration.

BACKGROUND OF THE INVENTION

The present invention relates to the hydrotreatment of tars derived from the pyrolysis of coals to saturate and reduce the molecular weight of the tar constituents while removing bound sulfur, nitrogen and oxygen. Coal tars formed from pyrolysis and other thermal decomposition techniques can be upgraded by treatment with hydrogen at elevated temperatures and pressures over sulfided nickel, molybdenum and cobalt containing catalysts.

Direct contact of the substantially liquefied tars with the catalyst in the hydrogenation zone suffers from the difficulty that at the higher temperatures, the residence times necessary to achieve hydrogenation of the unsaturates in the coal tars favors the tendency of coke formation from the heavier molecules in the feed stock. Coke, in this instance, is a high molecular weight crosslinked material formed by the cross-linking of molecules through sites of unsaturation to yield a polymer which will further condense to free carbon before melting occurs. The coke which forms settles on and rapidly occludes the catalyst.

The coke forming tendency can be reduced by increasing effective hydrogen pressure. This, however, leads to increased hydrogen consumption in undesired side reactions leading to total saturation of the molecules. This is undesired, as the most utile product of the hydrogenation are low boiling hydrocarbons boiling at a temperature from about 300 to about 750° F and which are highly aromatic in nature. The increased hydrogen consumption is wasteful of a costly manufactured commodity.

A need exists, therefore, for a hydrogenation process which minimizes coke formation without sacrificing the quality of the hydrocarbons as the desired product of hydrogenation.

SUMMARY OF THE INVENTION

In accordance with the present invention, hydrocarbon tars of an asphaltene content of about 50 to about 75 weight percent as derived from thermal pyrolysis of coal are hydrogenated by dissolving the tars in a hydrocarbon solvent product of hydrogenation, subjecting the fluid mixture to catalytic, substantially liquid phase hydrogenation at pressures of at least about 1500 psi in the presence of an externally supplied hydrogen in an amount at least three times the amount of hydrogen consumed to increase the effective combined hydrogen content of the product, preferably to from about 1.2 to about 1.5 atoms of hydrogen per atom of carbon. This yields a product which includes generated hydrocarbon solvent for the hydrocarbon tars. Hydrogenation occurs at a temperature above about 500° F up to the critical temperature of the solvent and under conditions whereby a substantial portion of the hydrocarbons fed are maintained in the liquid state.

The nature of the gross product produced may vary widely depending upon the degree of hydrogenation carried out. In any instance, however, the liquid hydrocarbon solvent formed will be highly aromatic in nature. That portion of the product formed and employed as the solvent for the hydrocarbon tars is separated from the residue by flash vaporization.

The amount of solvent utilized to dissolve the hydrocarbon tars will depend, in part, on its aromaticity and is generally provided in a weight ratio of hydrocarbon solvent to hydrocarbon tars of from about 1 to 4 to about 4 to 1.

As a consequence of conducting hydrogenation in the presence of an aromatic light hydrocarbon solvent formed from the hydrogenation process, there is avoided excess hydrogen consumption while at the same time eliminating or at least materially reducing the amount of coke formed during the hydrogenation step.

DESCRIPTION

According to the present invention, there is provided a process for hydrogenation of hydrocarbon tars. As used herein by the term "hydrocarbon tars", there is meant hydrocarbon substances of an asphaltene content of at least about 50% and typically from about 50 to about 75% by weight and generally having a boiling point above about 500° F. By the term "hydrocarbon solvent" there is meant an aromatic hydrocarbon formed from the hydrogenation of the hydrocarbon tars and having a boiling point from about 300° to about 750° F.

In accordance with the process of this invention, the hydrocarbon tar is dissolved prior to hydrogenation in the hydrocarbon solvent to form a fluid mixture suitable for introduction to a hydrogenation zone. Generally, for adequate fluid flow, the weight ratio of the hydrocarbon tar to the hydrocarbon solvent will range from about 1 to 4 or more, to about 4 to 1 or less. Lower ratios may be used with some sacrifice in pumping requirements due to increased viscosity of the fluid and higher ratios may be used at the expense of recycling larger volumes of the solvent to no particular advantage.

The mixture of hydrocarbon tars dissolved in the hydrocarbon solvent is passed through a hydrogenation zone maintained at a temperature of at least about 500° F, preferably from 500° F to the critical temperature of the solvent, more preferably from about 500° to about 800° F. Operating pressures for the present state of catalyst art is from about 1500 psig to about 5000 psig, preferably from about 2000 to about 3500 psig. In any event, conditions are such that a substantial portion of the hydrocarbon feed is maintained in a liquid state. It is particularly preferred that operation be at a pressure above the critical pressure of hydrocarbon solvent and at a temperature below its critical temperature.

In the hydrogenation zone, the heavy hydrocarbon-light hydrocarbon solvent mixture is contacted with externally supplied hydrogen in the presence of the hydrogenation catalyst which serves to cleave the heavier hydrocarbons with hydrogen termination of the free radicals thus formed, and/or to achieve partial saturation.

The amount of hydrogen introduced to the hydrogenation zone is at least about 3 and preferably from about 3 to about 10 times the amount consumed in the hydrogenation reactions. The most desired products are those containing from about 1.2 to about 1.5 atoms of hydrogen per atom of carbon as compared to the 1 to 1 ratio typically present in the hydrocarbon tar. Generally, the amount of hydrogen introduced to achieve this result will range from about 10,000 to about 20,000 standard cubic feet per barrel of tar, generally resulting in a consumption of about 2000 to about 5000 standard cubic feet per barrel of tar.

Excess hydrogen and high hydrogen pressure serve several important functions. Excess hydrogen acts as an inert gas to carry its reaction product with bound sulfur, oxygen and nitrogen, i.e. hydrogen sulfide, water and ammonia out of the system and facilitate their recovery in separate operations. In addition, the high hydrogen pressure promotes the desired reactions to the avoidance of coke formation. The asphaltenes tend to coke at the catalyst surface. At high hydrogen pressures and concentrations, hydrogen is continuously available at the catalyst surfaces to react with the heavy asphaltene molecules reaching the catalyst before coke formation occurs. The diluent is also important to this result as will be explained.

The essentially liquid phase hydrogenation occurs in the presence of a catalyst. Although any hydrotreating catalyst can be employed such as Group VI and/or Group VIII metals in their oxides and/or sulfide state are preferably supported. Preferred catalysts are the sulfided nickel molybdenum or sulfided cobalt molybdenum catalyst in which the sulfided metal is contained on a support such as silica, alumina, silica-alumina, silicamagnesia, zirconia, titania and the like with alumina preferred. The catalyst may be employed as fixed bed, mixing bed, fluidized bed and the like.

The degree of breakdown of the tars during the hydrogenation step normally depend upon the catalyst employed and the severity of reaction conditions. Generally, the rate of fluid flow relative to the catalyst will range from about 0.1 to about 10 LHSV.

At low hydrogen concentrations and mild hydrogenation conditions, the process may be employed mainly to reduce the bound nitrogen, oxygen and sulfur content of the hydrocarbons with some production of the lower boiling paraffinic hydrocarbons. Under severe conditions, a high degree of molecular weight reduction occurs favoring the production of lower boiling aromatic hydrocarbons which serve as part of the hydrocarbon solvent for the tars.

The effluent from the hydrogenation zone is processed to separate the solvent from the residue for recycle. This can be accomplished by flash vaporization of the produced hydrocarbon solvent at a reduced pressure followed by condensation of the hydrocarbon solvent for use in dissolving additional heavy hydrocarbons. The heavy residue may then be subject to fractional distillation.

Where hydrogenation is carried out to the degree that essentially all of the product will be the hydrocarbon solvent, a portion of the product after separation from the gas phase is recycled for use as the solvent for the hydrocarbon tar feed.

Within these parameters, there resides a great deal of flexibility of operation permitting a full range of hydrogenation conditions to customize the product to the desired end product specification.

One characteristic of the process is the minimization of saturation of the aromatic hydrocarbons, such that the product will be high in aromatic content and elimination or minimization of coke formation. These results are believed to be achieved to at least some extent because of the action of the solvent on the heavy constituents particularly the asphaltenes found in the heavy hydrocarbon feed. The solvent tends to break these high molecular weight aggregates and dilute them for exposure to high pressure hydrogen and to segregate the molecules to prevent competitive interaction between the molecules which leads to the formation of the coke. It will be appreciated, of course, that partial hydrogenation can occur prior to or simultaneous with molecular weight reduction.

The hydrogen employed for hydrogenation may be purchased hydrogen or hydrogen resulting from a hydrogen generated at the site.

The operation for which the process of this invention is particularly adapted is in hydrogenation of tars resulting from the liquefaction of coal. By "coal" there is included anthracite coal, bituminous coal, sub-bituminous coal, lignite, peat and the like. The pyrolysis of coal under essentially nonoxidizing conditions leads to the formation of a pyrolytic vapor containing condensible and noncondensible hydrocarbons as well as a solid carbon containing residue such as char. The condensible hydrocarbons include the hydrocarbons which constitutes the tars, and lower boiling constituents which may constitute a solvent for the tars. This hydrocarbon solvent, when hydrogenated with the tars and recycled, forms the hydrocarbon solvent. For start up, a commercial coal tar extract may be employed and be supplanted as product solvent is generated in the hydrogenation reaction.

The solid carbon containing product of pyrolysis is an ideal source for the generation of hydrogen for use in hydrogenation process by virtue of conducting a reaction between the contained carbon and steam. This yields a gaseous stream containing hydrogen and the oxides of carbon. The oxides of carbon, in turn, can interact with carbon constituents found in the tars to generate additional hydrogen internal of the hydrogenation zone.

In addition, the constituents of the solvent can serve as hydrogen donors which provide hydrogen which, in the presence of the catalyst, terminates the free radicals which may develop during breakdown of the heavy hydrocarbons. Tetralin, for example, and similar saturated and partially saturated molecules in the hydrocarbon solvent have been established as hydrogen donors which reduce the severity of operating conditions to achieve a desired degree of hydrogenation and the amount of hydrogen consumed in the hydrotreating operation. In this sense, the hydrogen may be carried by an easily accessible hydrogen recipient until such time as free radicals come into existence. The free radicals extract the hydrogen from the second generation donor in a chain of sequential hydrogen exchange reactions.

As will be appreciated, hydrogenation may be carried out stagewise in a plurality of hydrogenation zones in series. Hydrogen in this instance may be fed to the first and any or all of the hydrogenation zones in the series.

What is claimed is:

1. A process for hydrogenation of hydrocarbon tars of high asphaltene content which comprises:

(a) forming a fluid solution of a hydrocarbon tar having an asphaltene content at least about 50% by weight in an aromatic hydrocarbon solvent for the hydrocarbon tar, said aromatic hydrocarbon solvent having a boiling point of from about 300° to about 750° F and formed as a product during the hydrogenation of the hydrocarbon tar to a hydrogen content of from about 1.2 to about 1.5 atoms of hydrogen per atom of carbon;

(b) hydrogenating the tars while maintaining a substantial portion of the solution in the liquid state in the presence of a hydrogenation catalyst and externally supplied hydrogen in an amount of at least about 3 times the amount of hydrogen consumed during hydrogenation at a temperature above about 500° F and a pressure from about 1500 to about 5000 psig for a time sufficient to react hydrogen with the tars and reduce the molecular weight of the tar constituents to form additional aromatic hydrocarbon solvent for the tars; and (c) recovering at least a portion of the aromatic hydrocarbon solvent formed during the hydrogenation from the effluent of the hydrogenation zone and using the recovered aromatic hydrocarbon solvent in preparing the solution of hydrocarbon tar for feed to the hydrogenation zone.

2. A process as claimed in claim 1 in which the hydrocarbon solvent is recovered from the effluent of the hydrogenation zone by flash vaporization.

3. A process as claimed in claim 1 in which the hydrogenation temperature is from about 500° F to the critical temperature of the hydrocarbon solvent.

4. A process as claimed in claim 1 in which the hydrogenation temperature is from about 500° to about 800° F.

5. A process as claimed in claim 1 in which the hydrogenation pressure is from about 2000 to about 3500 psig.

6. A process as claimed in claim 1 in which the amount of hydrogen consumed in the hydrogenation zone is sufficient to provide an effluent having an atomic hydrogen to carbon ratio of from about 1.2 to about 1.5.

7. A process as claimed in claim 1 in which the hydrogen fed to the hydrogenation zone is from about 3 to about 10 times the amount of hydrogen consumed in the hydrogenation zone.

8. A process as claimed in claim 7 in which the amount of hydrogen consumed in the hydrogenation zone is sufficient to provide an effluent having an atomic hydrogen to carbon ratio of from about 1.2 to about 1.5.

9. A process as claimed in claim 1 in which the weight ratio of hydrocarbon tar to hydrocarbon solvent is from about 1 to 4 to about 4 to 1.

10. A process for hydrogenation of hydrocarbon tars resulting from the coal pyrolysis which comprises:

(a) generating a hydrocarbon tar containing from about 50 to about 75 weight percent asphaltenes from pyrolysis of coal;

(b) forming a liquid solution as a hydrocarbon tar in an aromatic hydrocarbon solvent for the tar, said aromatic hydrocarbon solvent having a boiling point of from about 300° to about 750° F and being formed as a product during the hydrogenation of the hydrocarbon tar to a hydrogen content of from about 1.2 to about 1.5 atoms of hydrogen per atom of carbon;

(c) hydrogenating the tars while maintaining a substantial portion of the solution in the liquid state in the presence of a hydrogenation catalyst and externally supplied hydrogen in an amount of at least about 3 times the amount of hydrogen consumed during hydrogenation, at a temperature from about 500° F to the critical temperature of the hydrocarbon solvent and at a pressure from about 1500 to about 5000 psig for a time sufficient to react hydrogen with the tar and reduce the molecular weight of the tar constituents to form additional aromatic hydrocarbon solvent for the tar; and (d) recovering at least a portion of the aromatic hydrocarbon solvent formed during the hydrogenation from the hydrogenation zone for direct use in preparing the solution of hydrocarbon tar for feed to the hydrogenation zone.

11. A process as claimed in claim 10 in which the hydrocarbon solvent is recovered from the effluent of the hydrogenation zone by flash vaporization.

12. A process as claimed in claim 10 in which the hydrogenation temperature is from about 500° F to the critical temperature of the hydrocarbon solvent.

13. A process as claimed in claim 10 in which the hydrogenation temperature is from about 500° to about 800° F.

14. A process as claimed in claim 10 in which the hydrogenation pressure is from about 2000 to about 3500 psig.

15. A process as claimed in claim 10 in which the amount of hydrogen consumed in the hydrogenation zone is sufficient to provide an effluent having an atomic hydrogen to carbon ratio of from about 1.2 to about 1.5.

16. A process as claimed in claim 10 in which the hydrogen fed to the hydrogenation zone is from about 3 to about 10 times the amount of hydrogen consumed in the hydrogenation zone.

17. A process as claimed in claim 16 in which the amount of hydrogen consumed in the hydrogenation zone is sufficient to provide an effluent having an atomic hydrogen to carbon ratio of from about 1.2 to about 1.5.

18. A process as claimed in claim 10 in which the weight ratio of hydrocarbon tar to hydrocarbon solvent is from about 1 to 4 to about 4 to 1.

* * * * *